US006978702B1

(12) United States Patent
Diggle, III et al.

(10) Patent No.: US 6,978,702 B1
(45) Date of Patent: Dec. 27, 2005

(54) MULTI-PURPOSE HAND TOOL

(75) Inventors: Frederick James Diggle, III, Birmingham, AL (US); Jacob P. Jackson, Cullman, AL (US)

(73) Assignee: BellSouth Intellectual Property Corporation, Atlanta, GA (US)

( * ) Notice: Subject to any disclaimer, the term of this patent is extended or adjusted under 35 U.S.C. 154(b) by 0 days.

(21) Appl. No.: 10/666,498

(22) Filed: Sep. 19, 2003

(51) Int. Cl.[7] ..... B25B 13/00
(52) U.S. Cl. ..... 81/124.4; 81/121.1; 81/124.3
(58) Field of Search ..... 81/121.1, 124.4, 81/124.3, 124.6, 125.1, 186, 176.15, 119, 81/26

(56) References Cited

U.S. PATENT DOCUMENTS 198,544 A * 12/1877 Kettlewell ..... 81/124.6
1,187,417 A * 6/1916 Cobb ..... 7/138
1,281,438 A * 10/1918 Tuttle ..... 81/124.5
1,613,981 A * 1/1927 Carlberg ..... 81/124.5
3,416,395 A * 12/1968 Hanson ..... 81/125
3,877,327 A * 4/1975 Erm ..... 81/124.4
4,291,425 A * 9/1981 Sweitzer ..... 7/100
4,840,094 A * 6/1989 Macor ..... 81/185
4,856,387 A * 8/1989 Gibson ..... 81/124.4
4,887,498 A 12/1989 Zayat
D339,040 S * 9/1993 Piecuch et al. ..... D8/26
5,285,543 A * 2/1994 Rowe ..... 7/138
5,460,064 A 10/1995 Zayat, Jr.
5,622,090 A 4/1997 Marks
D385,762 S 11/1997 Marks
5,768,961 A * 6/1998 Frawley ..... 81/128
5,791,209 A 8/1998 Marks
6,085,619 A 7/2000 Blake et al.
6,098,503 A * 8/2000 Hlinka ..... 81/124.3
D433,296 S * 11/2000 Yamakawa ..... D8/29
6,260,452 B1 * 7/2001 Yu ..... 81/177.2

OTHER PUBLICATIONS

U.S. Appl. No. 10/668,091, filed Sep. 19, 2003.

* cited by examiner

*Primary Examiner*—Lee D. Wilson
*Assistant Examiner*—Alvin J. Grant
(74) *Attorney, Agent, or Firm*—Lee & Hayes, PLLC

(57) ABSTRACT

A multi-purpose hand tool is disclosed. According to various embodiments, the tool may include a socket body and a shaft arm. The socket body may include a first socket at a first end and a second socket at a second end. The sockets may be differently sized. The shaft arm is connected to the socket body. According to one embodiment, the shaft arm may be a multi-sided key, such as a hex key, for turning female fasteners (i.e., fasteners, such as bolts or screws, with opening for receiving the shaft arm). The socket body may be cylindrical and the shaft arm may extend radially from the socket body.

20 Claims, 3 Drawing Sheets

MULTI-PURPOSE HAND TOOL

BACKGROUND

The present invention is directed, in various embodiments, to a multi-purpose hand tool.

To service and upgrade telecommunications infrastructure, the various telephone service providers in the United States alone employ approximately 200,000 service technicians. Among other things, these technicians are required to access and enter serving terminals, cross-boxes, subscriber loop connection (SLC) cabinets, etc. Each of these cabinets/boxes typically has a different type of locking mechanism, requiring the service technician to carry as part of his everyday-gear a multitude of different tools.

For example, service technicians typically enter cabinets with a combination of passkeys, hex keys and sockets. For example, to open a SLC cabinet the service technician must typically use two separate tools—both a hex key and a 7/16" socket. The socket may be part of a tubular, double-ended seven-inch tool called a "terminal wrench." The terminal wrench typically has the 7/16" socket on one end, which is also used to lock and unlock cross-boxes, plastic covers on some elevated serving terminal and pedestals. The other end of the terminal wrench typically has a 3/8" socket used to torque protectors and ground wire bolts in ONIs (outside network interfaces) in addition to tightening and loosening binding posts.

The diameter of conventional terminal wrenches, however, is so small that it is difficult for technicians to apply sufficient torque to properly lock cross-boxes, for example. This drawback is especially troublesome if the locking bolt on the cross-box seizes due to, for example, temperature changes. The result is that the service technicians are often careful not to lock cross-boxes too tightly for fear of having trouble opening it later. This can be a potential security threat as loose locking bolts are less likely to deter mischief.

Further, conventional terminal wrenches have unnecessary mass and size, making them cumbersome for service technicians to constantly carry, especially when one considers that service technicians are often required to climb telephone poles and otherwise exhibit nimbleness in servicing hard-to-reach equipment.

SUMMARY

In one general respect, the present invention is directed in various embodiments to a multi-purpose hand tool. Embodiments of the tool may include a socket body and a shaft arm. The socket body may include a first socket at a first end and a second socket at a second end. The sockets may be differently sized. The shaft arm is connected to the socket body. According to one embodiment, the shaft arm may be a multi-sided key, such as a hex key, for turning female fasteners (i.e., fasteners, such as bolts or screws, with opening for receiving the shaft arm). The socket body may be cylindrical and the shaft arm may extend radially from the socket body.

An embodiment of the tool may replace the combination of the hex wrench and the terminal wrench currently used in most cases to open SLC cabinets, thus replacing two tools with one that is more compact and weighs less. That is, the combination of one of the sockets (such as a 7/16" socket) and the key shaft arm could be used to open a SLC cabinet. No other implement would be needed in most cases to access these devices. Further, the other socket (such as a 3/8" socket) could be used, for example, to tighten or loosen binding posts. Second, the key shaft arm may provide the technician with greater torque control than exists with convention terminal wrenches. Third, the tool, in comparison with a conventional terminal wrench, may provide an additional function, namely torquing female fasteners with the key shaft arm.

Other variations and adaptations of the tool will be or become apparent to one of skill in the art upon review of the following drawings and detailed description. It is intended that all such additional variations and adaptations be included with this description, be within the scope of the present invention, and be protected by the accompanying claims.

DESCRIPTION OF THE DRAWINGS

Embodiments of the present invention will be described in conjunction with the following figures, which are not drawn to scale, wherein.

DESCRIPTION

Figure 3:
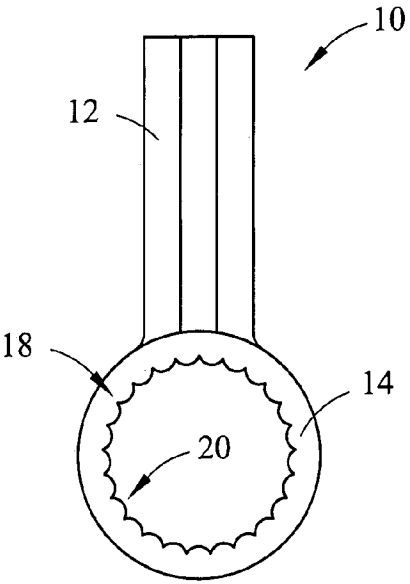
FIGS. 1–4 illustrate various embodiments of the tool.
Figure 2:
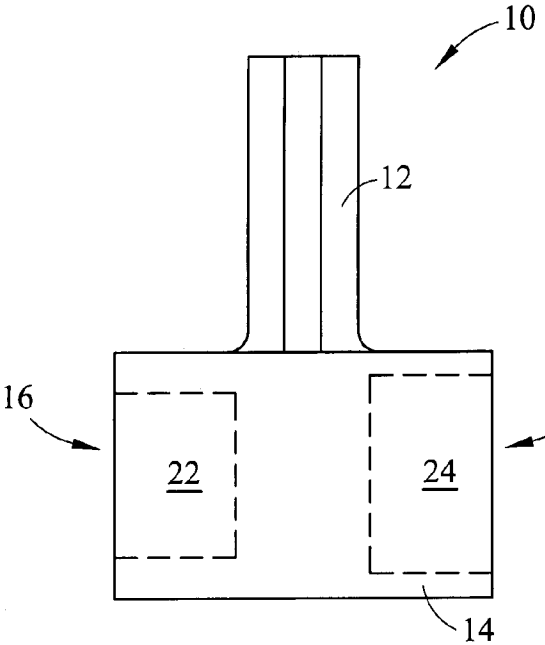
Figure 4:
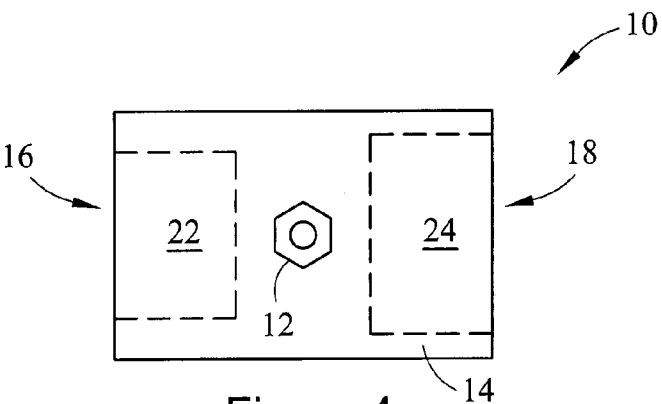
Figure 1:
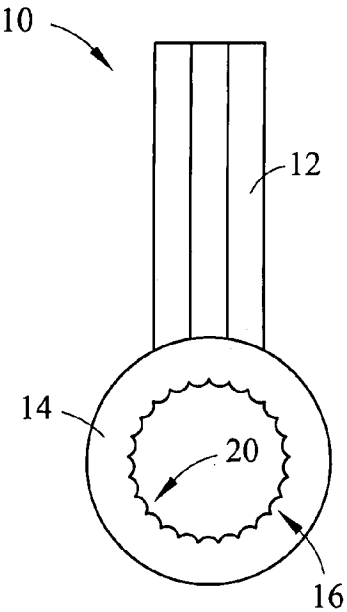

FIGS. 1–4 illustrate various embodiments of the multi-purpose hand tool 10. FIG. 1 is a front view of the tool 10; FIG. 2 is a side view of the tool 10; FIG. 3 is a back view of the tool 10; and FIG. 4 is a top view of the tool 10. As can be seen in FIGS. 1–4, the tool 10 may include a multi-sided key shaft arm 12 connected to an approximate midpoint of a socket body 14 and extending perpendicularly to the longitudinal axis of the socket body 14. The socket body 14 may be, for example, cylindrical (as shown in FIGS. 1 and 3) and the key shaft arm 12 may extend radially from the socket body 14. According to other embodiments, the socket body 14 may be poly-sided.

The socket body 14 may include two sockets 16, 18 on the front and back ends, respectively, of the socket body 14. According to one embodiment, the front socket 16 may be a 3/8" socket and the back socket 18 may be a 7/16" socket. The sockets 16, 18 may include, for example, protruding teeth 20 for engaging a screw, bolt or other type of fastener to be turned by the tool 10. The sockets 16, 18 may define openings 22, 24, respectively, deep enough to receive the fastener.

The key shaft arm 12 may be for turning female fasteners, such as bolts or screws having a corresponding opening for receiving the key shaft arm 12. According to one embodiment, the key shaft arm 12 may be, for example, a hex key with six sides, as shown in FIG. 4. In addition, the key shaft arm 12 may be hollow as shown in FIG. 4.

The tool 10 may be sized for convenient usage by the user. According to various embodiments, the key shaft arm 12 may be 1" to 2" in length and the socket body 14 may be 1" to 2" in longitudinal length. In operation, the user may turn a fastener with one of the sockets 16, 18 by placing the socket over the fastener and torquing the tool 10 may turning the key shaft arm 12 in a roll direction. In another mode of operation, the user may place the multi-sided key shaft arm 12 in a correspondingly shaped opening of a female fastener (e.g., screw or bolt) and torquing the tool 10 by turning the socket body 14 in a yaw direction.

The tool 10, including the key shaft arm 12 and the socket body 14, may be made of any material sufficient for the intended purpose. For example, the tool 10 may include materials such as metal, metal alloys, steel and/or steel alloys. According to one embodiment, the tool 10 may include carbide steel. In addition, the tool 10 may be formed by forging metal, such as drop forging, press forging, roll forging or cold forging.

Figure 6:
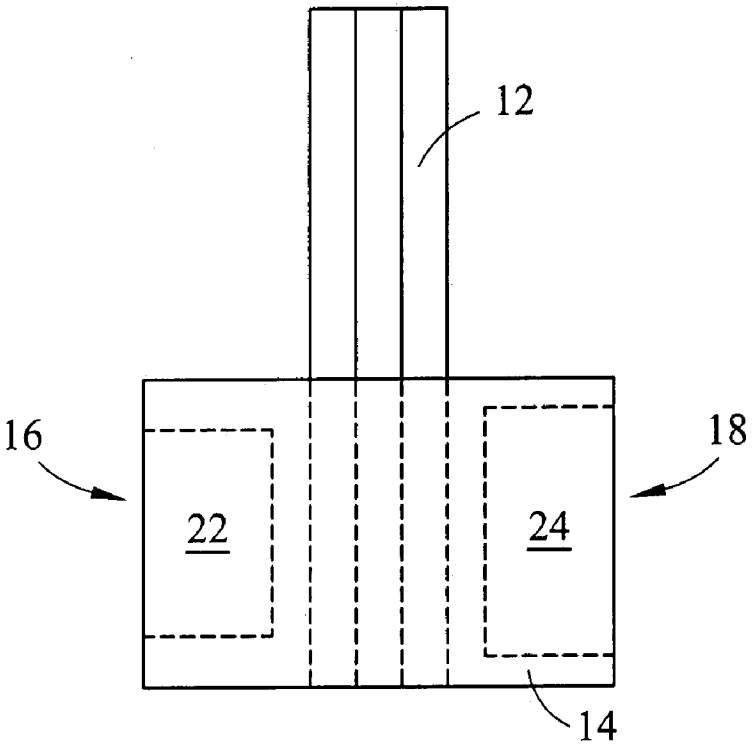
FIGS. 5–7 are side views of the tool according to various embodiments.
Figure 5:
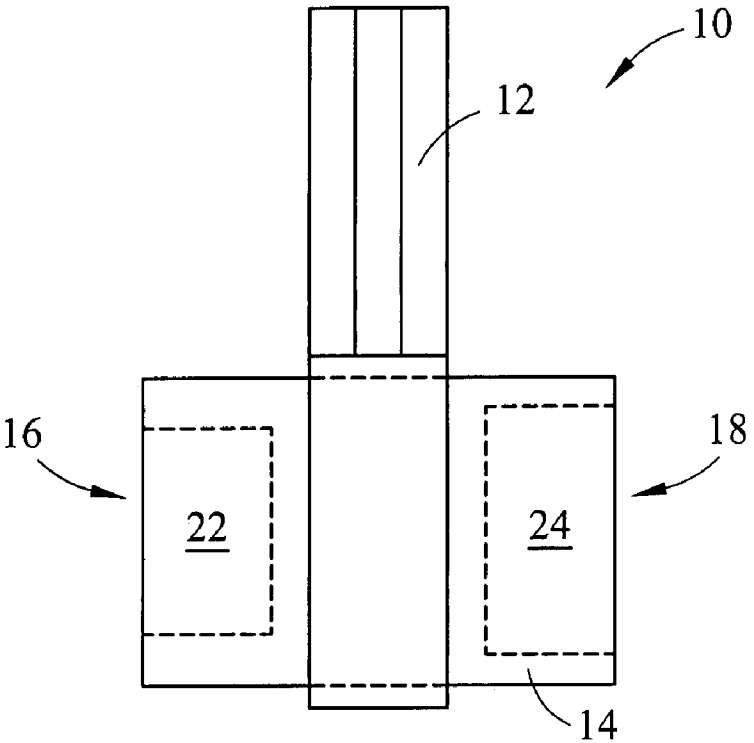

The key shaft arm 12 may be connected to the socket body in any manner suitable for the intended purpose. For example, the key shaft arm 12 may be cast in the socket body 14, welded to the socket body 14, wrapped around and welded to the socket body 14, as shown in FIG. 5, or passed through an opening of the socket body 14 and welded, as shown in FIG. 6.

Embodiments of the tool 10 may be suited for telecommunication service technicians in that it may, for example, solve or mitigate many problems experienced by telephone service technicians. For example, an embodiment of the tool 10 may replace the combination of the hex wrench and the terminal wrench currently used in most cases to open SLC cabinets, thus replacing two tools with one that is more compact and weighs less. That is, the combination of the one of the sockets 18 (such as a 7/16" socket) and the key shaft arm 12 could be used to open a SLC cabinet. No other implement would be needed in many cases to access these devices. Further, the socket 16 (such as a 3/8" socket) could be used, for example, to tighten or loosen binding posts. Second, the key shaft arm 12 may provide the technician with greater torque control than exists with convention terminal wrenches. Third, the tool 10, in comparison with a conventional terminal wrench, may provide an additional function, namely torquing female fasteners with the key shaft arm 12.

Figure 7:
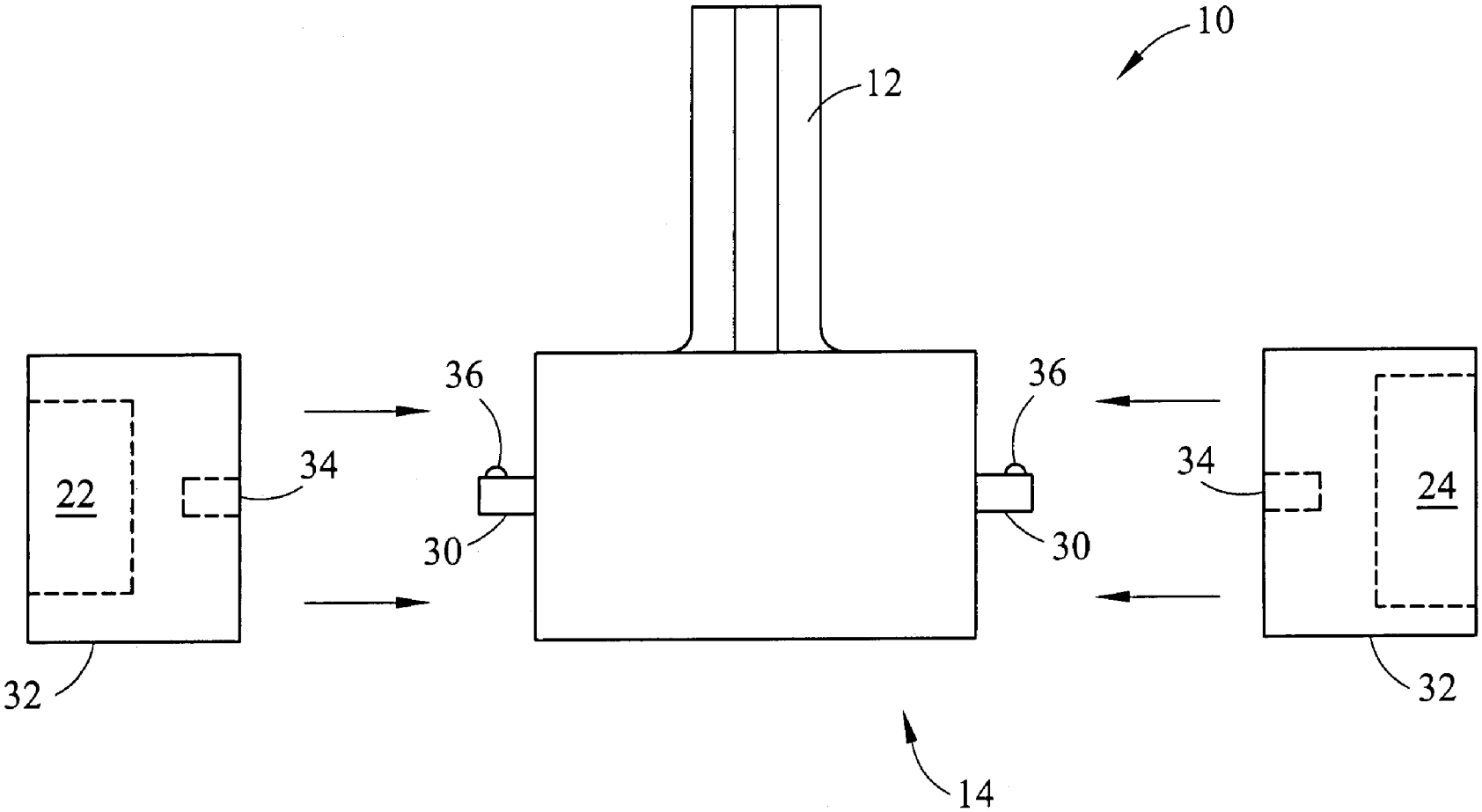

According to another embodiment, as illustrated in FIG. 7, the socket body 14 may include drive posts 30 connected to each end of the socket body 14. The drive posts 30, which may be rectangular shaped studs protruding outwardly from the socket body along the longitudinal axis, may be for receiving detachable sockets 32. The detachable sockets 32 may include an opening 34 for receiving the drive post 30. To facilitate engaging of the detachable sockets 32 to the socket body 14, the drive posts 30 may include a detent ball 36. In addition, according to another embodiment, the drive posts 30 may each have a ratchet drive mechanism (not shown) connected thereto to permit ratcheting of the detachable sockets 32.

According to various embodiments, one or both of the detachable sockets 30 may be a universal or self-forming socket. A universal socket may include a plurality of retractable pins (not shown) bundled in parallel within the housing of the socket. The bundled pins may displace longitudinally and may be biased by a spring (not shown) or other biasing means away from a frame (not shown) onto which the pins are slidably held. In addition, a spacer pin (not shown) may be positioned at the center of the socket, which also may be biased away from the frame. Embodiments of such a universal or self-forming socket are described in U.S. Pat. Nos. 4,887,498; 5,460,064; 5,791,209; 5,622,090; and 6,085,619, which are incorporated herein by reference. With such a self-forming socket, when forced over a fastener, nut or bolt head, groups of the pins may be pushed inward toward the frame and into the housing of the socket, thereby configuring the pins to the contours of the fastener. Application of a torque to the socket, such as by rotating the shaft arm 12, may transfer the torque through the bundled pins of the socket to the fastener, thereby permitting loosening or tightening of the fastener. The pins may be arranged in, for example, a hexagonal arrangement and the socket may have, for example, cylindrical or rectangular shape. The self-forming socket may have an outer diameter of, for example, one inch and the bundled pins may be capable of gripping, for example, bolt heads as small as 1/4" and as large as 3/4".

What is claimed is:

1. A multi-purpose hand tool, comprising:

a socket body, the socket body including a first socket defining a first cavity at a first end of the socket body and a second socket defining a second cavity at a second end of the socket body, the first cavity being independent of, and separated from, the second cavity by a non-hollow core; and a shaft arm connected to the socket body, the shaft arm being configured to fit in an opening of a female fastener to turn the female fastener, and the shaft arm being hollow and having an opening in a distal end thereof.

2. The tool of claim 1, wherein the shaft arm is connected perpendicular to a longitudinal axis of the socket body.

3. The tool of claim 2, wherein the socket body is cylindrical.

4. The tool of claim 2, wherein the shaft arm includes a multi-sided key shaft arm.

5. The tool of claim 2, wherein the multi-sided key shaft arm includes a hex key.

6. The tool of claim 1, wherein:

the first cavity defines a first opening for receiving a first fastener to be turned by the tool; and the second cavity defines a second opening for receiving a second fastener to be turned by the tool, wherein the size of the first opening does not equal the size of the second opening.

7. The tool of claim 1, wherein at least one of the first and second sockets is detachably connected to the socket body.

8. The tool of claim 7, wherein the first socket includes a self-forming socket.

9. The tool of claim 7, wherein the first and second sockets are detachably connected to the socket body by first and second drive posts, respectively, and wherein each of the first and second drive posts has a ratchet drive mechanism connected thereto to permit ratcheting of the first and second drive posts.

10. The tool of claim 1, wherein the shaft arm is welded to the socket body.

11. The tool of claim 10, wherein the shaft arm is disposed in an opening defined by the socket body.

12. The tool of claim 10, wherein the shaft arm is disposed around the socket body.

13. The tool of claim 1, wherein the shaft arm is cast to the socket body.

14. The tool of claim 1, wherein each of the socket body and the shaft arm is sized to be 1–2 inches in length.

15. A multi-purpose hand tool, comprising:

a cylindrical socket body, the socket body including a first socket defining a first cavity at a first end of the socket body and a second socket defining a second cavity at a second end of the socket body, the first cavity being independent of, and separated from, the second cavity by a non-hollow core; and a shaft arm fixedly connected to the socket body such that the shaft arm extends radially from the socket body, the shaft arm being configured to fit in an opening of a female fastener to turn the female fastener, and the shaft arm being hollow and having an opening in a distal end thereof.

16. The tool of claim 15, wherein the shaft arm extends from a longitudinal center of the socket body and includes a multi-sided key shaft arm.

17. The tool of claim 16, wherein:

the first cavity defines a first opening for receiving a first fastener to be turned by the tool; and the second cavity defines a second opening for receiving a second fastener to be turned by the tool, wherein the size of the first opening does not equal the size of the second opening.

18. The tool of claim 17, wherein at least one of the first socket and the second socket is detachably connected to the socket body.

19. A multi-purpose hand tool, comprising:

a single-piece body having a socket portion and means for torquing the socket portion, wherein the socket portion has a non-hollow core with a first cavity therein to define a first socket and a second cavity therein to define a second socket, wherein the means for torquing further comprises means for fitting in an opening of a female fastener and for turning the female fastener, and wherein the means for torquing is hollow and has an opening in a distal end thereof.

20. The tool of claim 19, wherein the first cavity is a different size than the second cavity.

* * * * *